US008043198B2

(12) United States Patent
Zhou

(10) Patent No.: US 8,043,198 B2
(45) Date of Patent: Oct. 25, 2011

(54) MULTI-FUNCTION SIT-UP APPARATUS

(75) Inventor: Yuzhi Zhou, Fujian (CN)

(73) Assignee: Xiamen Zhoulong Sporting Goods Co., Ltd., Fujian (CN)

( * ) Notice: Subject to any disclaimer, the term of this patent is extended or adjusted under 35 U.S.C. 154(b) by 0 days.

(21) Appl. No.: 12/323,908

(22) Filed: Nov. 26, 2008

(65) Prior Publication Data

US 2009/0186749 A1 Jul. 23, 2009

(30) Foreign Application Priority Data

Jan. 18, 2008 (CN) ..... 2008 2 0101195 U

(51) Int. Cl.
*A63B 26/00* (2006.01)

(52) U.S. Cl. ..... 482/140

(58) Field of Classification Search ..... 482/140, 482/907, 139, 142, 91, 92–93, 148, 121–130
See application file for complete search history.

(56) References Cited

U.S. PATENT DOCUMENTS

| | | | | |
|---|---|---|---|---|
| 4,248,420 | A * | 2/1981 | Hayes | 482/131 |
| 5,569,138 | A * | 10/1996 | Wang et al. | 482/130 |
| 6,605,022 | B2 * | 8/2003 | Webber | 482/138 |
| 6,685,607 | B1 * | 2/2004 | Olson | 482/142 |
| 7,083,555 | B1 * | 8/2006 | McPartland | 482/140 |
| 7,291,102 | B2 * | 11/2007 | Mackert et al. | 482/130 |
| 7,322,907 | B2 * | 1/2008 | Bowser | 482/121 |
| 7,393,310 | B2 * | 7/2008 | Andrews | 482/131 |

* cited by examiner

*Primary Examiner* — Lori Baker

(57) ABSTRACT

A multi-function sit-up apparatus includes a frame, a seat and a back pad. The seat and the back pad are disposed on the frame. The back of the back pad is provided with a pair of arm pull devices. By the arm pull devices, the user sits on the seat and lies on the back pad with his/her hands to pull the pull handles to strengthen the abdominal muscles, arms and pectoral, providing a multi-function exercise effect.

2 Claims, 5 Drawing Sheets

MULTI-FUNCTION SIT-UP APPARATUS

BACKGROUND OF THE INVENTION

1. Field of the Invention

The present invention relates to an exercise machine, and more particularly to a multi-function sit-up apparatus.

2. Description of the Prior Art

Nowadays, people are busy to work and there are not sufficient outdoor exercise facilities. Most people buy exercise equipment for exercise at home, such as a sit-up board. The sit-up board comprises a frame, a seat on the frame, a back pad, and an adjusting mechanism to adjust the back pad. A footrest is provided at a front end of the frame. In use, the back pad is adjusted for a desired angle. The user sits on the seat with his/her feet on the footrest and back on the back pad to do sit-up exercise for strengthening the abdominal muscles.

SUMMARY OF THE INVENTION

The primary objective of the present invention is to provide a multi-function sit-up apparatus for strengthening the abdominal muscles, arms and pectoral.

According to the present invention, there is provided a multi-function sit-up apparatus, comprising a frame, a seat and a back pad, the seat and the back pad being disposed on the frame, the back of the back pad being provided with a pair of arm pull devices.

Preferably, each of the arm pull devices comprises a support board, a resilient rope and a pull handle, the support board having an inner end pivoted to the back of the back pad and an outer end provided with a pulley, the resilient rope having a first end secured to the support board and a second end striding the pulley to be connected with the pull handle.

Preferably, the back of the support board is provided with a number of retaining bases, the support board having inner and outer ends provided with pulleys, the front of the support board being provided with a connecting base, the connecting base being provided with a pulley, the resilient rope having the first end connected to one of the retaining bases and the second end striding the pulleys on the inner and outer ends of the support board and the pulley of the connecting base to be connected with the pull handle.

Preferably, the first end of the resilient rope is provided with a hook to be hooked on one of the retaining bases.

By the arm pull devices, the user sits on the seat and lies on the back pad with his/her hands to pull the pull handles to strengthen the abdominal muscles, arms and pectoral, providing a multi-function exercise effect.

DETAILED DESCRIPTION OF THE PREFERRED EMBODIMENT

Figure 1:
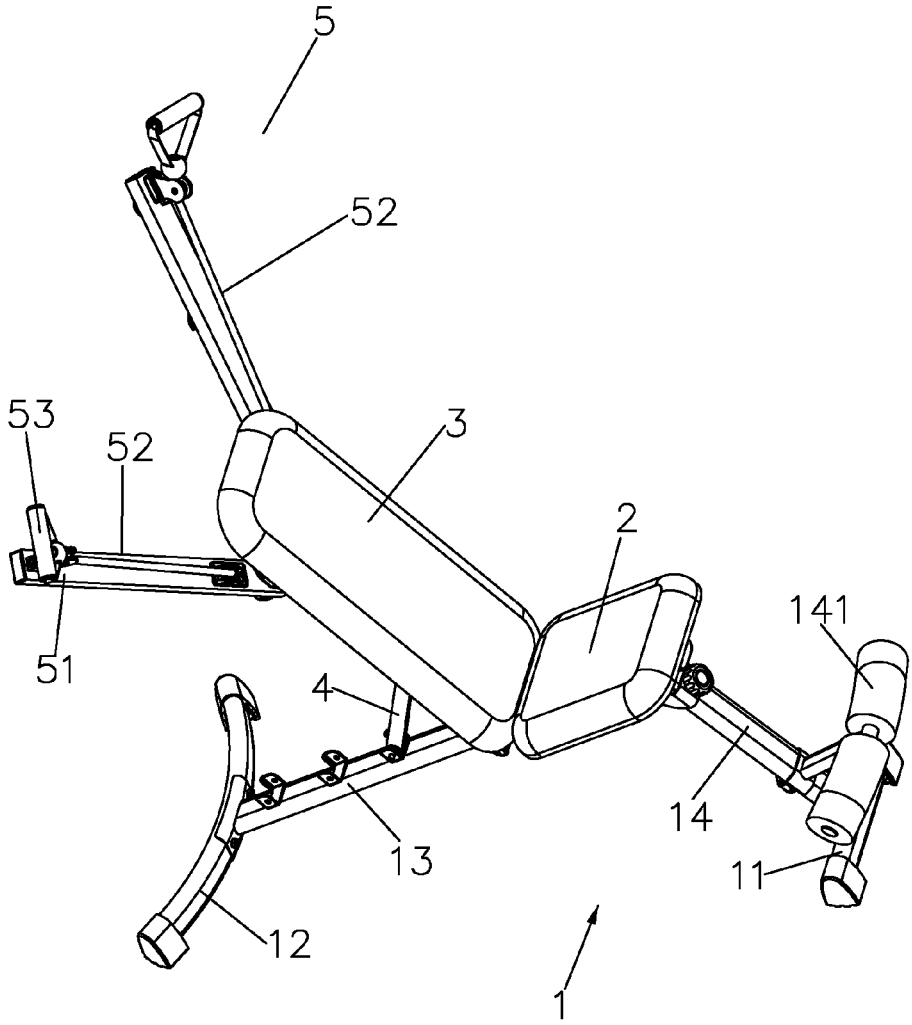
FIG. 1 is a perspective view of the present invention.
Figure 3:
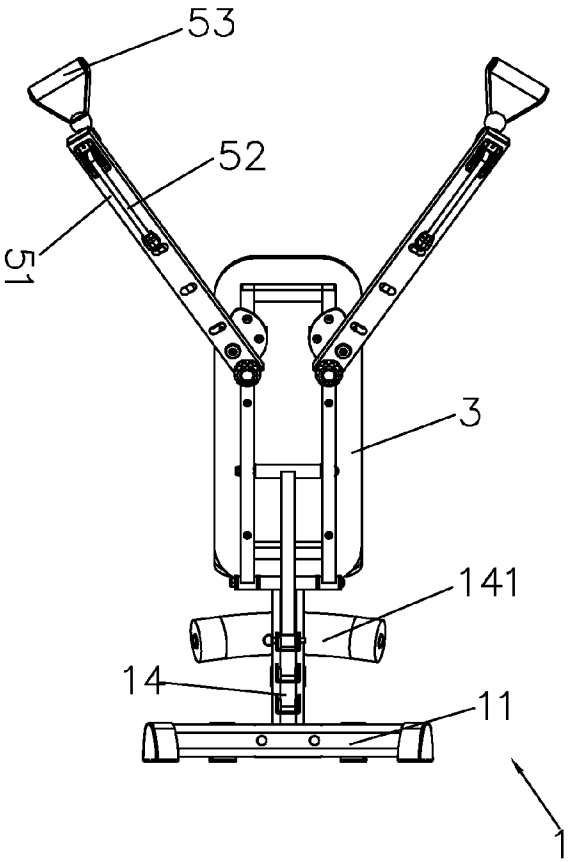
FIG. 3 is a rear view of the present invention.
Figure 2:
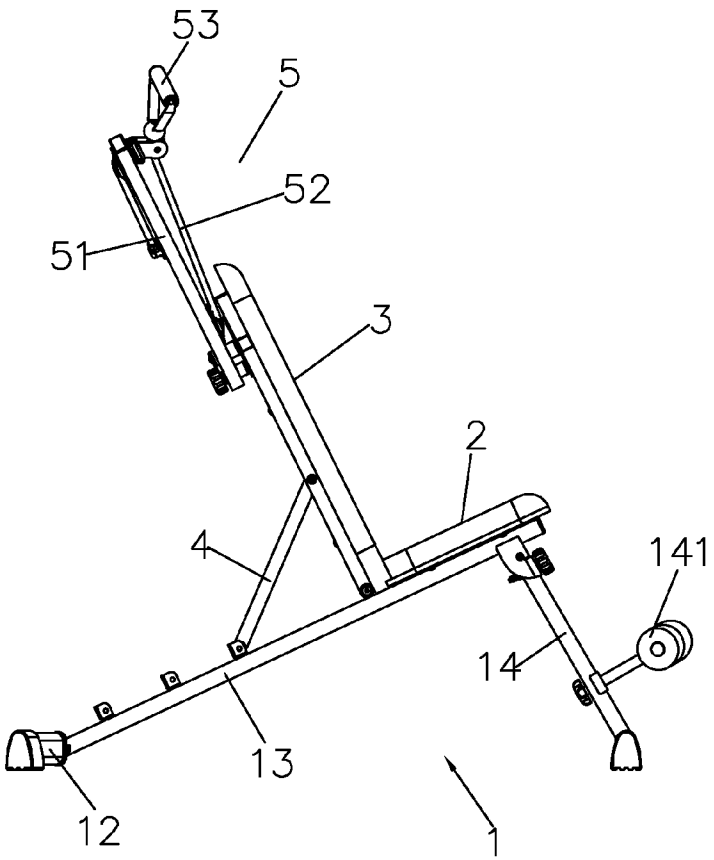
FIG. 2 is a side view of the present invention.

As shown in FIGS. 1 through 3, a multi-function sit-up apparatus comprises a frame 1, a seat 2, a back pad 3, and an adjusting mechanism 4.

The frame 1 comprises a pair of cross bars 11 and 12 at front and rear ends thereof, a long oblique rod 13 and a short oblique rod 14 located between the cross bars 11 and 12. The long oblique rod 13 and the short oblique rod 14 are connected like English capital letter L. The seat 2 is disposed on an upper end of the long oblique rod 13. The back pad 3 is pivotally connected to the long oblique rod 13 next to the seat 2. A lower section of the short oblique rod 14 is provided with a footrest 141. A number of retaining blocks 131 are provided on a lower section of the long oblique rod 13. The adjusting mechanism 4 is a rod which has one end pivoted to the back of the back pad 3 and the other end connected to one of the retaining blocks 131 such that the back pad 3 is adjustable with respect to the seat 2. The retaining blocks may be disposed on the back of the back pad 3, while one end of the adjusting mechanism 4 is pivotally connected to the long oblique rod 13 and the other end of the adjusting mechanism 4 is connected to one of the retaining blocks on the back pad 3 to adjust the angle of the back pad 3 with respect to the seat 2. To use the present invention, the user sits on the seat 2 with his/her feet on the footrest 141 and the back on the back pad 3 for sit-up training exercise commonly performed with the aim of strengthening the abdominal muscles.

Figure 4:
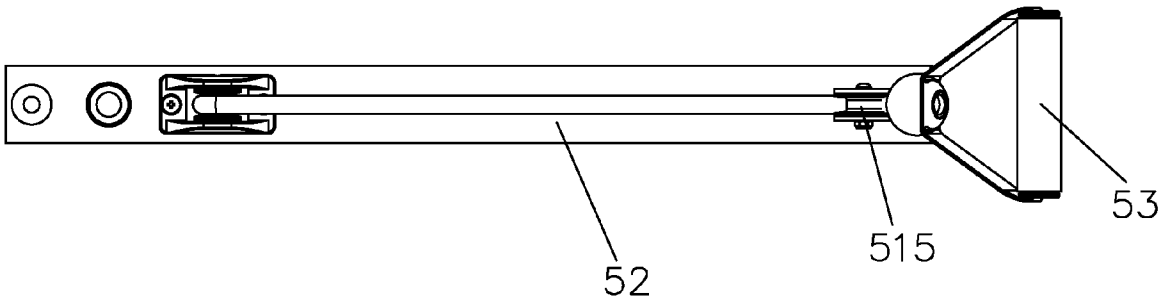
FIG. 4 is a front view of an arm pull device of the present invention.
Figure 5:
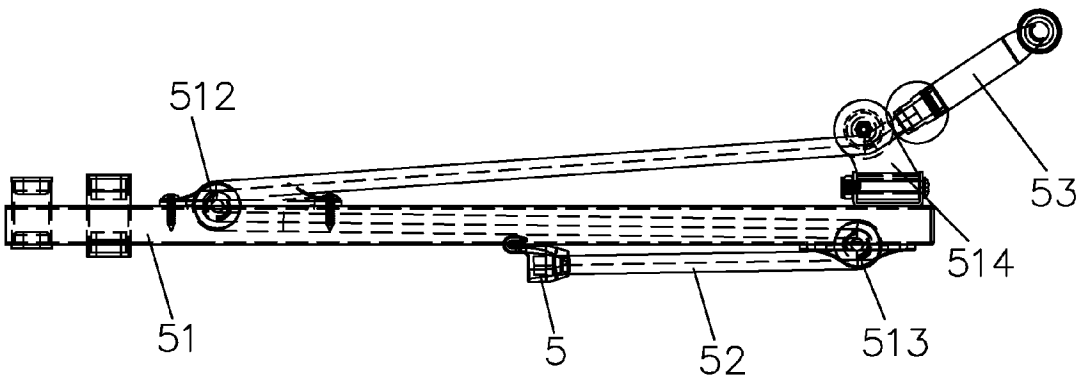
FIG. 5 is a side view of the arm pull device of the present invention.

As shown in FIGS. 4 and 5, the back of the back pad 3 is provided with a pair of arm pull devices 5 at an upper section thereof. Each arm pull device 5 comprises a support board 51, a resilient rope 52, and a pull handle 53. The support board 51 has an inner end and an outer end. The inner end of the support board 51 is pivoted to the back of the back pad 3. A number of retaining bases 511 are provided on the back of the support bard 51. The inner and outer ends of the support board 51 are provided with pulleys 512 and 513. A connecting base 514 is provided on an upper end of the front of the support board 51. A pulley 515 is provided on the connecting base 514. A first end of the resilient rope 52 is connected with a hook 521 to be hooked on one of the retaining bases 511. A second end of the resilient rope 52 goes across the pulleys 512 and 513 and the pulley 515 of the connecting base 514 to be connected with the pull handle 53. The hook 521 can be hooked on one of the retaining bases 511 to adjust the pulling force with respect to the resilient rope 52. The pull handle 53 of the arm pull device 5 is disposed on the outer end of the support board 51. The user lies on the back pad 3 and stretches his/her hands to pull the pull handles 53, strengthening the arm and pectoral.

Figure 7:
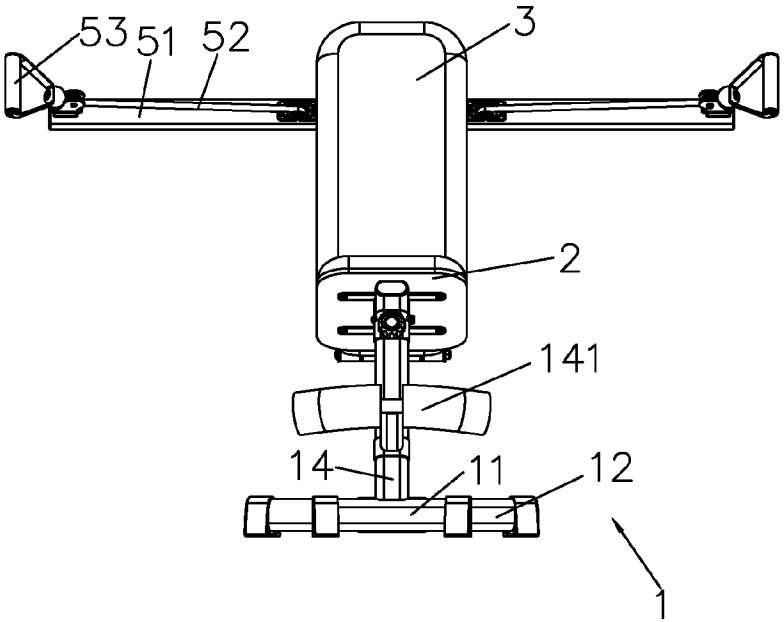
FIG. 7 is a schematic view of a second embodiment of the present invention.
Figure 6:
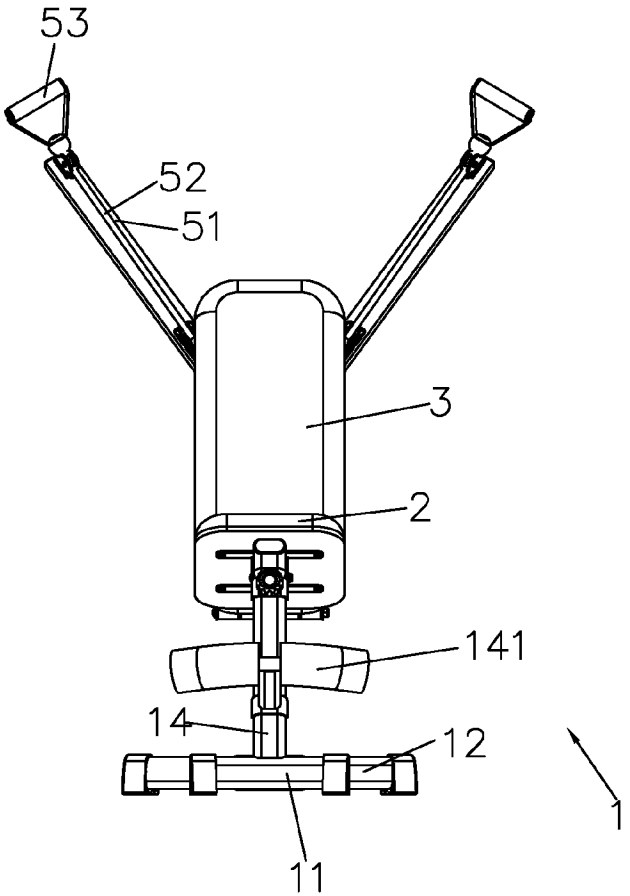
FIG. 6 is a schematic view of a first embodiment of the present invention.
Figure 8:
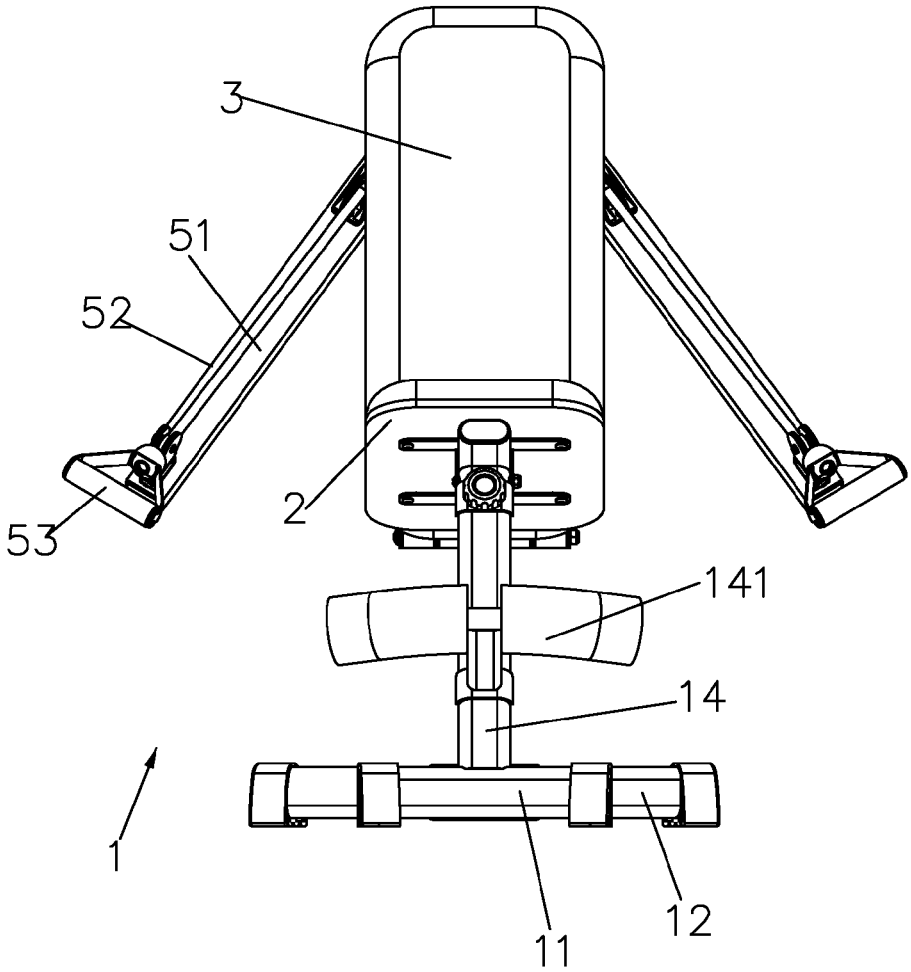
FIG. 8 is a schematic view of a third embodiment of the present invention.

As shown in FIG. 6, when the outer ends of the adjusting boards 51 are adjusted upwards and located above the back pad 3, the pull handles 53 are pulled downwards with respect to the body to strengthen the arms. As shown in FIG. 7, when the outer ends of the adjusting boards 51 are adjusted and located near two sides the back pad 3, the pull handles 53 are pulled inwards with respect to the body to strengthen the arms. As shown in FIG. 8, when the outer ends of the adjusting boards 51 are adjusted downward, the pull handles 53 are pulled upwards with respect to the body to strengthen the arms.

The movable connection of the arm pull devices 5 is selective for strengthening the arm and pectoral in many ways. The sit-up apparatus of the present invention has this auxiliary structure, providing multi-function exercise for the abdominal muscles, arms and pectoral.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function sit-up apparatus, comprising a frame, a seat and a back pad, the seat and the back pad being disposed on the frame, the back of the back pad being provided with a pair of arm pull devices, wherein each of the arm pull devices comprises a support board, a resilient rope and a pull handle, the support board having an inner end pivoted to the back of the back pad and an outer end provided with a pulley, the resilient rope having a first end secured to the support board and a second end striding the pulley to be connected with the pull handle, the back of the support board is provided with a plurality of retaining bases, the support board having inner and outer ends provided with pulleys, the front of the support board being provided with a connecting base, the connecting base being provided with a pulley, the resilient rope having the first end connected to one of the retaining bases and the second end striding the pulleys on the inner and outer ends of the support board and the pulley of the connecting base to be connected with the pull handle.

2. The multi-function sit-up apparatus as claimed in claim 1, wherein the first end of the resilient rope is provided with a hook to be hooked on one of the retaining bases.

* * * * *